US012467464B2

(12) United States Patent
Kabasawa

(10) Patent No.: US 12,467,464 B2
(45) Date of Patent: Nov. 11, 2025

(54) VACUUM PUMP AND VACUUM EXHAUST APPARATUS

(71) Applicant: Edwards Japan Limited, Chiba (JP)

(72) Inventor: Takashi Kabasawa, Chiba (JP)

(73) Assignee: Edwards Japan Limited, Chiba (JP)

( * ) Notice: Subject to any disclaimer, the term of this patent is extended or adjusted under 35 U.S.C. 154(b) by 125 days.

(21) Appl. No.: 18/546,510

(22) PCT Filed: Feb. 25, 2022

(86) PCT No.: PCT/JP2022/007939

§ 371 (c)(1),
(2) Date: Aug. 15, 2023

(87) PCT Pub. No.: WO2022/186076

PCT Pub. Date: Sep. 9, 2022

(65) Prior Publication Data

US 2024/0141907 A1 May 2, 2024

(30) Foreign Application Priority Data

Mar. 5, 2021 (JP) ..... 2021-035687

(51) Int. Cl.
*F04D 19/04* (2006.01)
*F04D 29/58* (2006.01)
*F04D 29/70* (2006.01)

(52) U.S. Cl.
CPC ..... *F04D 19/042* (2013.01); *F04D 29/5853* (2013.01); *F04D 29/701* (2013.01)

(58) Field of Classification Search
CPC .. F04D 19/042; F04D 29/5853; F04D 29/701; F04D 29/584; F04D 29/582; F04D 19/04
See application file for complete search history.

(56) References Cited

U.S. PATENT DOCUMENTS 4,926,648 A * 5/1990 Okumura ..... F04D 19/046 62/55.5
5,443,368 A * 8/1995 Weeks ..... F04D 27/00 417/42

(Continued)

FOREIGN PATENT DOCUMENTS

EP 0694699 A1 1/1996
EP 3779202 A1 2/2021

(Continued)

OTHER PUBLICATIONS

European Communication dated Dec. 11, 2024 and Supplemental Search Report dated Dec. 2, 2024 for corresponding European application Serial No. EP22763132, 8 pages.

(Continued)

*Primary Examiner* — Bryan M Lettman

(74) *Attorney, Agent, or Firm* — Theodore M. Magee; Westman, Champlin & Koehler, P.A.

(57) ABSTRACT

A vacuum pump includes a heater, purge gas introduction ports, a purge gas valve, and an exhaust valve. In a cleaning operation mode, at least one of the heater, the purge gas valve, and the exhaust valve is controlled, and a pressure in at least a part of an interior of the turbomolecular pump is increased to a pressure region with which a temperature is greater than or equal to a sublimation temperature of the deposits in the turbomolecular pump and that causes an intermediate flow or a viscous flow.

7 Claims, 9 Drawing Sheets

(56) References Cited

U.S. PATENT DOCUMENTS

| | | | | |
|---|---|---|---|---|
| 5,618,167 | A * | 4/1997 | Hirakawa | F04D 29/5853 417/372 |
| 8,052,376 | B2 | 11/2011 | Yamawaku et al. | |
| 2005/0249618 | A1* | 11/2005 | Nonaka | F04D 19/04 417/423.4 |
| 2020/0092952 | A1* | 3/2020 | Ohtachi | F04D 19/042 |
| 2021/0010479 | A1* | 1/2021 | Miwata | F04D 19/046 |
| 2021/0018003 | A1* | 1/2021 | Kabasawa | F04D 19/04 |
| 2022/0097000 | A1* | 3/2022 | Lee | H01J 37/32834 |

FOREIGN PATENT DOCUMENTS

| | | | | |
|---|---|---|---|---|
| JP | 09310696 | A | 12/1997 | |
| JP | 2010272228 | A | 12/2010 | |
| JP | 2011080407 | A | 4/2011 | |
| JP | 2013119798 | A | 6/2013 | |
| JP | 2018150837 | A | 9/2018 | |
| JP | 2020002838 | A | 1/2020 | |
| JP | 2021507172 | A | 2/2021 | |
| JP | 2021042722 | A | 3/2021 | |
| WO | WO2018164013 | A1 * | 9/2018 | F04D 19/04 |

OTHER PUBLICATIONS

PCT International Search Report dated May 24, 2022 for corresponding PCT application Serial No. PCT/JP2022/007939, 2 pages.
PCT International Written Opinion dated May 24, 2022 for corresponding PCT application Serial No. PCT/JP2022/007939, 3 pages.
Japanese Notification of Reasons for Refusal dated Apr. 22, 2025 for corresponding Japanese application Serial No. 2021-035687, 4 pages.

* cited by examiner

VACUUM PUMP AND VACUUM EXHAUST APPARATUS

CROSS-REFERENCE OF RELATED APPLICATION

This application is a Section 371 National Stage Application of International Application No. PCT/JP2022/007939, filed Feb. 25, 2022, which is incorporated by reference in its entirety and published as WO 2022/186076A1 on Sep. 9, 2022 and which claims priority of Japanese Application No. 2021-035687, filed Mar. 5, 2021.

FIELD

The present invention relates to a vacuum pump including a turbomolecular pump, for example, and a vacuum exhaust apparatus.

BACKGROUND

A turbomolecular pump is commonly known as one type of vacuum pump. In a turbomolecular pump, a motor in a pump main body is energized to rotate rotor blades, which hit gaseous molecules of the gas (process gas) drawn into the pump main body, thereby exhausting the gas. Some types of such turbomolecular pumps have heaters and cooling pipes to appropriately control the temperature inside the pumps. Also, the applicant has proposed a vacuum pump system in which a turbomolecular pump is switched between a normal operation mode and a cleaning operation mode.

SUMMARY OF INVENTION

In the vacuum pump system proposed by the applicant (Japanese Patent Application No. 2019-165839), the temperature of the vacuum pump is controlled to be higher in the cleaning operation mode than in the normal operation mode. However, depending on the state of the deposits, the performance of cleaning (cleaning performance) may not be sufficiently exercised in some cases.

It is an object of the present invention to provide a vacuum pump and a vacuum exhaust apparatus that can improve the cleaning performance.

(1) To achieve the above object, the present invention is directed to a vacuum pump wherein a heating means, a gas introduction means, and a pressure control means are disposed, the vacuum pump has, as an operation mode, a cleaning mode that is capable of sublimating deposits in the vacuum pump, and the vacuum pump is configured to, in the cleaning mode, control at least one of the heating means, the gas introduction means, and the pressure control means and increase a pressure in at least a part of an interior of the vacuum pump to a pressure region with which a temperature is greater than or equal to a sublimation temperature of the deposits in the vacuum pump and that causes an intermediate flow or a viscous flow.

(2) To achieve the above object, another aspect of the present invention is directed to the vacuum pump according to (1), wherein at least a part of the interior of the vacuum pump is controlled such that a first set pressure that causes an intermediate flow or a viscous flow and a second set pressure that causes a molecular flow are alternately repeated.

(3) To achieve the above object, another aspect of the present invention is directed to the vacuum pump according to (1) or (2), wherein, in the cleaning mode, a rotational speed of the vacuum pump is set lower than in a normal state.

(4) To achieve the above object, another aspect of the present invention is directed to the vacuum pump according to any one of (1) to (3), wherein, in the cleaning mode, a partial pressure of gas generated by sublimation of the deposits is controlled to be less than or equal to half of a sublimation pressure of the deposits.

(5) To achieve the above object, another aspect of the present invention is directed to the vacuum pump according to any one of (1) to (4), wherein, in the cleaning mode, a pressure in at least a part of the vacuum pump is increased to 2 [Torr] or more.

(6) To achieve the above object, another aspect of the present invention is directed to the vacuum pump according to (5) wherein, in the cleaning mode, a pressure in at least a part of the vacuum pump is increased to 10 [Torr] or less.

(7) To achieve the above object, another aspect of the present invention is directed to the vacuum pump according to any one of (1) to (6), wherein gas supplied from the gas introduction means to the vacuum pump includes at least one of nitrogen gas, helium gas, and hydrogen gas.

(8) To achieve the above object, another aspect of the present invention is directed to a vacuum exhaust apparatus including: a vacuum pump;

a heating means;

a gas introduction means; and a pressure control means, wherein the vacuum exhaust apparatus has, as an operation mode, a cleaning mode that is capable of sublimating deposits in the vacuum pump, and the vacuum exhaust apparatus is configured to, in the cleaning mode, control at least one of the heating means, the gas introduction means, and the pressure control means and increase a pressure in at least a part of an interior of the vacuum pump to a pressure region with which a temperature is greater than or equal to a sublimation temperature of the deposits in the vacuum pump and that causes an intermediate flow or a viscous flow.

According to the above invention, it is possible to provide a vacuum pump and a vacuum exhaust apparatus capable of improving the cleaning performance.

The Summary is provided to introduce a selection of concepts in a simplified form that are further described in the Detail Description. This summary is not intended to identify key features or essential features of the claimed subject matter, nor is it intended to be used as an aid in determining the scope of the claimed subject matter.

DETAILED DESCRIPTION

Figure 1:
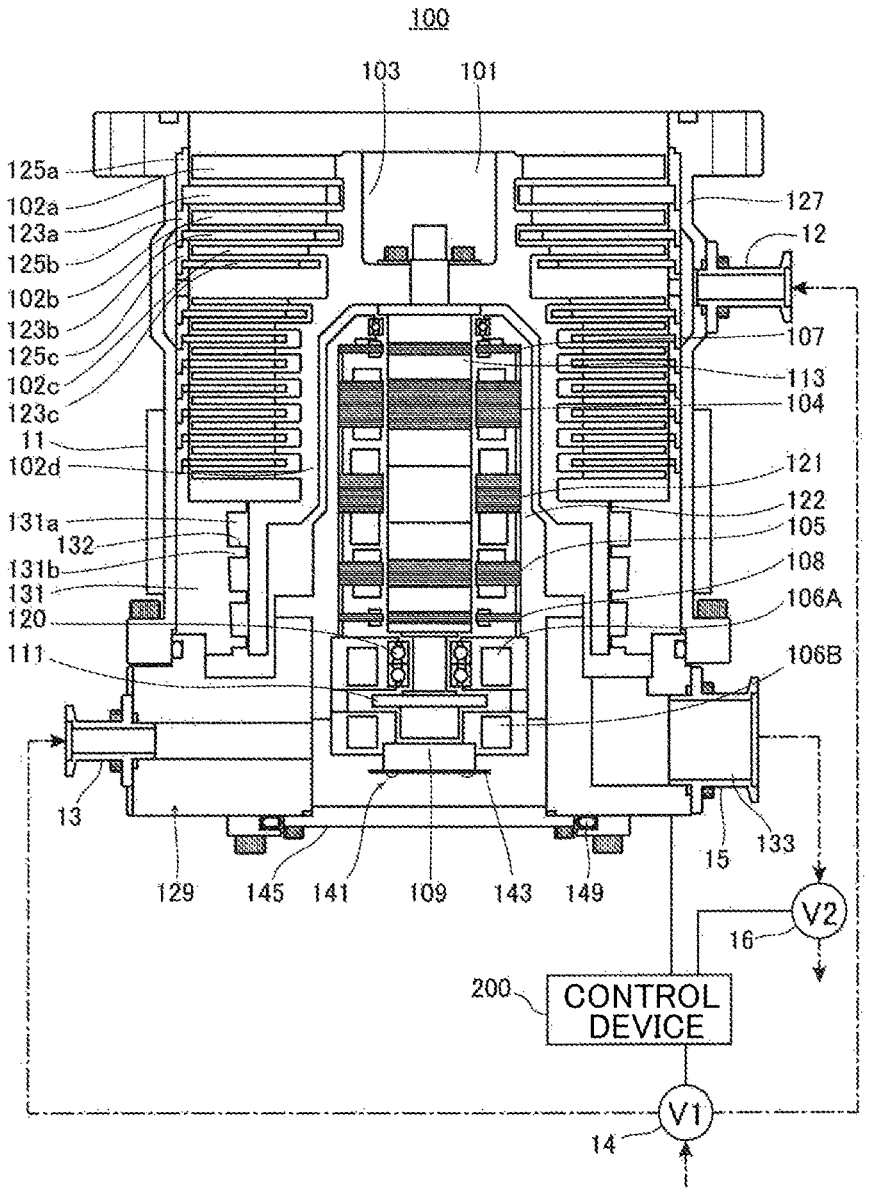
FIG. 1 is a configuration diagram of a vacuum pump according to an embodiment of the present invention.

Referring to the drawings, a vacuum pump 10 according to an embodiment of the present invention is now described. FIG. 1 shows the vacuum pump 10 according to an embodiment of the present invention. The vacuum pump 10 includes a turbomolecular pump 100 (pump apparatus), a pump control device (hereinafter simply referred to as a "control device") 200 for controlling the operation of the turbomolecular pump 100, and a heater 11 as a heating means.

The vacuum pump 10 also includes purge gas introduction ports 12 and 13 and a purge gas valve 14 (valve) for opening and closing the flow passage of the purge gas. In the present embodiment, the purge gas introduction ports 12 and 13 and the purge gas valve 14 each constitute a gas introduction means.

The vacuum pump 10 also includes an exhaust port 15 used for exhausting the gas in the pump, an exhaust valve 16 (pressure control means) arranged downstream of the turbomolecular pump 100, and the like. In the present embodiment, the exhaust port 15 and the exhaust valve 16 each constitute a gas exhaust means. In FIG. 1, the purge gas valve 14 is denoted by the symbol "V1" and the exhaust valve 16 is denoted by the symbol "V2" to distinguish between the valves 14 and 16.

Here, depending on how the invention is interpreted, the term "vacuum pump" may refer to the range from the purge gas valve 14 and the exhaust valve 16 to the turbomolecular pump 100 (pump apparatus) (including the heater 11). In another interpretation, the term "vacuum pump" may refer to a vacuum pump apparatus such as the turbomolecular pump 100 and various types of vacuum pump apparatus other than a turbomolecular pump as a generic concept. Also, the purge gas valve 14 and the exhaust valve 16 may be removably bolted to the turbomolecular pump 100, or fixed by welding or the like so as not to be readily separated.

The turbomolecular pump 100 shown in FIG. 1 is to be connected to a vacuum chamber (not shown) of a target apparatus such as a semiconductor manufacturing apparatus. The heater 11 heats the turbomolecular pump 100 from the outside, and the purge gas introduction ports 12 and 13 introduce purge gas (also referred to as protective gas, cleaning gas, and the like) into the turbomolecular pump 100, which will be described in detail below.

The exhaust valve 16 is controlled by a controller 23 (valve control means) of a control circuit portion 22 shown in FIG. 5 to adjust the flow rate of the gas flowing in the turbomolecular pump 100, which will be also described in detail below. The configuration of these devices and the cleaning operation with these devices are described below.

FIG. 1 shows a longitudinal cross-sectional view of the turbomolecular pump 100 described above. As shown in FIG. 1, the turbomolecular pump 100 has a circular outer cylinder 127 having an inlet port 101 at its upper end. A rotating body 103 in the outer cylinder 127 includes a plurality of rotor blades 102 (102*a*, 102*b*, 102*c*, . . . ), which are turbine blades for gas suction and exhaustion, in its outer circumference section. The rotor blades 102 extend radially in multiple stages. The rotating body 103 has a rotor shaft 113 in its center. The rotor shaft 113 is supported and suspended in the air and position-controlled by a magnetic bearing of 5-axis control, for example. The rotating body 103 is typically made of a metal such as aluminum or an aluminum alloy.

Upper radial electromagnets 104 include four electromagnets arranged in pairs on an X-axis and a Y-axis. Four upper radial sensors 107 are provided in close proximity to the upper radial electromagnets 104 and associated with the respective upper radial electromagnets 104. Each upper radial sensor 107 may be an inductance sensor or an eddy current sensor having a conduction winding, for example, and detects a position of the rotor shaft 113 based on a change in the inductance of the conduction winding, which changes according to the position of the rotor shaft 113. The upper radial sensors 107 are configured to detect a radial displacement of the rotor shaft 113, that is, the rotating body 103 fixed to the rotor shaft 113, and send it to the control device 200.

In the control device 200, for example, a compensation circuit having a PID adjustment function generates an excitation control command signal for the upper radial electromagnets 104 based on a position signal detected by the upper radial sensors 107. Based on this excitation control command signal, an amplifier circuit 150 (described below) shown in FIG. 2 controls and excites the upper radial electromagnets 104 to adjust a radial position of an upper part of the rotor shaft 113.

The rotor shaft 113 may be made of a high magnetic permeability material (such as iron and stainless steel) and is configured to be attracted by magnetic forces of the upper radial electromagnets 104. The adjustment is performed independently in the X-axis direction and the Y-axis direction. Lower radial electromagnets 105 and lower radial sensors 108 are arranged in a similar manner as the upper radial electromagnets 104 and the upper radial sensors 107 to adjust the radial position of the lower part of the rotor shaft 113 in a similar manner as the radial position of the upper part.

Additionally, axial electromagnets 106A and 106B are arranged so as to vertically sandwich a metal disc 111, which has a shape of a circular disc and is provided in the lower part of the rotor shaft 113. The metal disc 111 is made of a high magnetic permeability material such as iron. An axial sensor 109 is provided to detect an axial displacement of the rotor shaft 113 and send an axial position signal to the control device 200.

In the control device 200, the compensation circuit having the PID adjustment function may generate an excitation control command signal for each of the axial electromagnets 106A and 106B based on the signal on the axial position detected by the axial sensor 109. Based on these excitation control command signals, the amplifier circuit 150 controls and excites the axial electromagnets 106A and 106B separately so that the axial electromagnet 106A magnetically attracts the metal disc 111 upward and the axial electromagnet 106B attracts the metal disc 111 downward. The axial position of the rotor shaft 113 is thus adjusted.

As described above, the control device 200 appropriately adjusts the magnetic forces exerted by the axial electromagnets 106A and 106B on the metal disc 111, magnetically levitates the rotor shaft 113 in the axial direction, and suspends the rotor shaft 113 in the air in a non-contact manner. The amplifier circuit 150, which controls and excites the upper radial electromagnets 104, the lower radial electromagnets 105, and the axial electromagnets 106A and 106B, is described below.

The motor 121 includes a plurality of magnetic poles circumferentially arranged to surround the rotor shaft 113. Each magnetic pole is controlled by the control device 200 so as to drive and rotate the rotor shaft 113 via an electromagnetic force acting between the magnetic pole and the rotor shaft 113. The motor 121 also includes a rotational speed sensor (not shown), such as a Hall element, a resolver, or an encoder, and the rotational speed of the rotor shaft 113 is detected based on a detection signal of the rotational speed sensor.

Furthermore, a phase sensor (not shown) is attached adjacent to the lower radial sensors 108 to detect the phase of rotation of the rotor shaft 113. The control device 200 detects the position of the magnetic poles using both detection signals of the phase sensor and the rotational speed sensor.

A plurality of stator blades 123 (123*a*, 123*b*, 123*c*, . . . ) are arranged slightly spaced apart from the rotor blades 102 (102*a*, 102*b*, 102*c*, . . . ). Each rotor blade 102 (102*a*, 102*b*, 102*c*, . . . ) is inclined by a predetermined angle from a plane perpendicular to the axis of the rotor shaft 113 in order to transfer exhaust gas molecules downward through collision. The stator blades 123 (123*a*, 123*b*, 123*c*, . . . ) are made of a metal such as aluminum, iron, stainless steel, copper, or a metal such as an alloy containing these metals as components.

The stator blades 123 are also inclined by a predetermined angle from a plane perpendicular to the axis of the rotor shaft 113. The stator blades 123 extend inward of the outer cylinder 127 and alternate with the stages of the rotor blades 102. The outer circumference ends of the stator blades 123 are inserted between and thus supported by a plurality of layered stator blade spacers 125 (125*a*, 125*b*, 125*c*, . . . ).

The stator blade spacers 125 are ring-shaped members made of a metal, such as aluminum, iron, stainless steel, or copper, or an alloy containing these metals as components, for example. The outer cylinder 127 is fixed to the outer circumferences of the stator blade spacers 125 with a slight gap. A base portion 129 is located at the base of the outer cylinder 127. The base portion 129 has an outlet port 133 providing communication to the outside. The exhaust gas transferred to the base portion 129 through the inlet port 101 from the chamber (vacuum chamber) is then sent to the outlet port 133.

According to the application of the turbomolecular pump 100, a threaded spacer 131 may be provided between the lower part of the stator blade spacer 125 and the base portion 129. The threaded spacer 131 is a cylindrical member made of a metal such as aluminum, copper, stainless steel, or iron, or an alloy containing these metals as components. The threaded spacer 131 has a plurality of helical thread grooves 131*a* engraved in its inner circumference surface. When exhaust gas molecules move in the rotation direction of the rotating body 103, these molecules are transferred toward the outlet port 133 in the direction of the helix of the thread grooves 131*a*. In the lowermost section of the rotating body 103 below the rotor blades 102 (102*a*, 102*b*, 102*c*, . . . ), a cylindrical portion 102*d* extends downward. The outer circumference surface of the cylindrical portion 102*d* is cylindrical and projects toward the inner circumference surface of the threaded spacer 131. The outer circumference surface is adjacent to but separated from the inner circumference surface of the threaded spacer 131 by a predetermined gap. The exhaust gas transferred to the thread groove 131*a* by the rotor blades 102 and the stator blades 123 is guided by the thread groove 131*a* to the base portion 129.

The base portion 129 is a disc-shaped member forming the base section of the turbomolecular pump 100, and is generally made of a metal such as iron, aluminum, or stainless steel. The base portion 129 physically holds the turbomolecular pump 100 and also serves as a heat conduction passage. As such, the base portion 129 is preferably made of rigid metal with high thermal conductivity, such as iron, aluminum, or copper.

In this configuration, when the motor 121 drives and rotates the rotor blades 102 together with the rotor shaft 113, the interaction between the rotor blades 102 and the stator blades 123 causes the suction of exhaust gas from the chamber through the inlet port 101. The rotational speed of the rotor blades 102 is usually 20000 rpm to 90000 rpm, and the circumferential speed at the tip of a rotor blade 102 reaches 200 m/s to 400 m/s. The exhaust gas taken through the inlet port 101 moves between the rotor blades 102 and the stator blades 123 and is transferred to the base portion 129. At this time, factors such as the friction heat generated when the exhaust gas comes into contact with the rotor blades 102 and the conduction of heat generated by the motor 121 increase the temperature of the rotor blades 102. This heat is transferred to the stator blades 123 through radiation or conduction via gas molecules of the exhaust gas, for example.

The stator blade spacers 125 are joined to each other at the outer circumference portion and conduct the heat received by the stator blades 123 from the rotor blades 102, the friction heat generated when the exhaust gas comes into contact with the stator blades 123, and the like to the outside.

In the above description, the threaded spacer 131 is provided at the outer circumference of the cylindrical portion 102*d* of the rotating body 103, and the thread grooves 131*a* are engraved in the inner circumference surface of the threaded spacer 131. However, conversely, thread grooves may be engraved in the outer circumference surface of the cylindrical portion 102*d*, while a spacer having a cylindrical inner circumference surface may be arranged around the outer circumference surface.

According to the application of the turbomolecular pump 100, to prevent the gas drawn through the inlet port 101 from entering an electrical portion, which includes the upper radial electromagnets 104, the upper radial sensors 107, the motor 121, the lower radial electromagnets 105, the lower radial sensors 108, the axial electromagnets 106A, 106B, and the axial sensor 109, the electrical portion may be surrounded by a stator column 122. The inside of the stator column 122 is maintained at a predetermined pressure by purge gas.

In this case, piping (purge gas introduction ports 12 and 13) is provided in the outer cylinder 127 and the base portion 129 to introduce the purge gas through these pipes. The introduced purge gas is sent to the outlet port 133 through gaps between a protective bearing 120 and the rotor shaft 113, between the rotor and the stator of the motor 121, and between the stator column 122 and the inner circumference cylindrical portion of the rotor blade 102.

The turbomolecular pump 100 requires the identification of the model and control based on individually adjusted unique parameters (for example, various characteristics associated with the model). To store these control parameters, the turbomolecular pump 100 includes an electronic circuit portion 141 in its main body. The electronic circuit portion 141 may include a semiconductor memory, such as an EEPROM, electronic components such as semiconductor elements for accessing the semiconductor memory, and a substrate 143 for mounting these components. The electronic circuit portion 141 is housed under a rotational speed sensor (not shown) near the center, for example, of the base portion 129, which forms the lower part of the turbomolecular pump 100, and is closed by an airtight bottom lid 145.

Some process gas introduced into the chamber in the manufacturing process of semiconductors has the property of becoming solid when its pressure becomes higher than a predetermined value or its temperature becomes lower than a predetermined value. In the turbomolecular pump 100, the pressure of the exhaust gas is lowest at the inlet port 101 and highest at the outlet port 133. When the pressure of the process gas increases beyond a predetermined value or its temperature decreases below a predetermined value while the process gas is being transferred from the inlet port 101 to the outlet port 133, the process gas is solidified and adheres and accumulates on the inner side of the turbomolecular pump 100.

For example, when $SiCl_4$ is used as the process gas in an Al etching apparatus, according to the vapor pressure curve, a solid product (for example, $AlCl_3$) is deposited at a low vacuum (760 [Torr] to $10^{-2}$ [Torr]) and a low temperature (about 20 [° C.]) and adheres and accumulates on the inner side of the turbomolecular pump 100. When the deposits of the process gas accumulates in the turbomolecular pump 100, the accumulation may narrow the pump flow passage and degrade the performance of the turbomolecular pump 100. The above-mentioned product tends to solidify and adhere in areas with higher pressures, such as the vicinity of the outlet port 133 and the vicinity of the threaded spacer 131.

To solve this problem, conventionally, a heater or annular water-cooled tube 149 is wound around the outer circumference of the base portion 129, and a temperature sensor (such as a thermistor, described below) is embedded in the base portion 129, for example. The signal of this temperature sensor is used to perform control to maintain the temperature of the base portion 129 at a constant high temperature (set temperature) by heating with the heater or cooling with the water-cooled tube 149 (hereinafter referred to as TMS (temperature management system)). The present embodiment uses the above-mentioned heater 11 as a heater and performs this TMS as temperature control in the normal operation mode.

Figure 2:
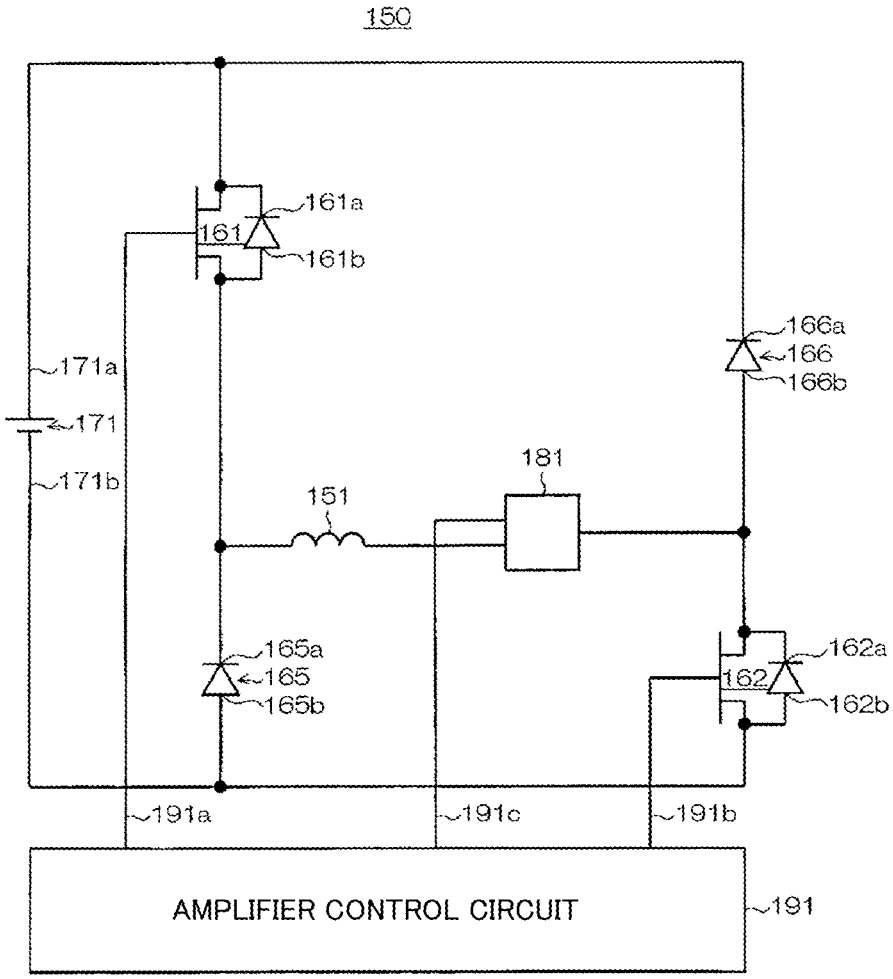
FIG. 2 is a circuit diagram of an amplifier circuit.

The amplifier circuit 150 is now described that controls and excites the upper radial electromagnets 104, the lower radial electromagnets 105, and the axial electromagnets 106A and 106B of the turbomolecular pump 100 configured as described above. FIG. 2 is a circuit diagram of the amplifier circuit 150.

In FIG. 2, one end of an electromagnet winding 151 forming an upper radial electromagnet 104 or the like is connected to a positive electrode 171*a* of a power supply 171 via a transistor 161, and the other end is connected to a negative electrode 171*b* of the power supply 171 via a current detection circuit 181 and a transistor 162. Each transistor 161, 162 is what is referred to as a power MOSFET and has a structure in which a diode is connected between the source and the drain thereof.

In the transistor 161, a cathode terminal 161*a* of its diode is connected to the positive electrode 171*a*, and an anode terminal 161*b* is connected to one end of the electromagnet winding 151. In the transistor 162, a cathode terminal 162*a* of its diode is connected to a current detection circuit 181, and an anode terminal 162*b* is connected to the negative electrode 171*b*.

A diode 165 for current regeneration has a cathode terminal 165*a* connected to one end of the electromagnet winding 151 and an anode terminal 165*b* connected to the negative electrode 171*b*. Similarly, a diode 166 for current regeneration has a cathode terminal 166*a* connected to the positive electrode 171*a* and an anode terminal 166*b* connected to the other end of the electromagnet winding 151 via the current detection circuit 181. The current detection circuit 181 may include a Hall current sensor or an electric resistance element, for example.

The amplifier circuit 150 configured as described above corresponds to one electromagnet. Accordingly, when the magnetic bearing uses 5-axis control and has ten electromagnets 104, 105, 106A, and 106B in total, an identical amplifier circuit 150 is configured for each of the electromagnets. These ten amplifier circuits 150 are connected to the power supply 171 in parallel.

An amplifier control circuit 191 may be formed by a digital signal processor portion (not shown, hereinafter referred to as a DSP portion) of the control device 200. The amplifier control circuit 191 switches the transistors 161 and 162 between on and off.

The amplifier control circuit 191 is configured to compare a current value detected by the current detection circuit 181 (a signal reflecting this current value is referred to as a current detection signal 191*c*) with a predetermined current command value. The result of this comparison is used to determine the magnitude of the pulse width (pulse width time Tp1, Tp2) generated in a control cycle Ts, which is one cycle in PWM control. As a result, gate drive signals 191*a* and 191*b* having this pulse width are output from the amplifier control circuit 191 to gate terminals of the transistors 161 and 162.

Under certain circumstances such as when the rotational speed of the rotating body 103 reaches a resonance point during acceleration, or when a disturbance occurs during a constant speed operation, the rotating body 103 may require positional control at high speed and with a strong force. For this purpose, a high voltage of about 50 V, for example, is used for the power supply 171 to enable a rapid increase (or decrease) in the current flowing through the electromagnet winding 151. Additionally, a capacitor is generally connected between the positive electrode 171*a* and the negative electrode 171*b* of the power supply 171 to stabilize the power supply 171 (not shown).

In this configuration, when both transistors 161 and 162 are turned on, the current flowing through the electromagnet winding 151 (hereinafter referred to as an electromagnet current iL) increases, and when both are turned off, the electromagnet current iL decreases.

Also, when one of the transistors 161 and 162 is turned on and the other is turned off, a freewheeling current is maintained. Passing the freewheeling current through the amplifier circuit 150 in this manner reduces the hysteresis loss in the amplifier circuit 150, thereby limiting the power consumption of the entire circuit to a low level. Moreover, by controlling the transistors 161 and 162 as described above, high frequency noise, such as harmonics, generated in the turbomolecular pump 100 can be reduced. Furthermore, by measuring this freewheeling current with the current detection circuit 181, the electromagnet current iL flowing through the electromagnet winding 151 can be detected.

Figure 3:
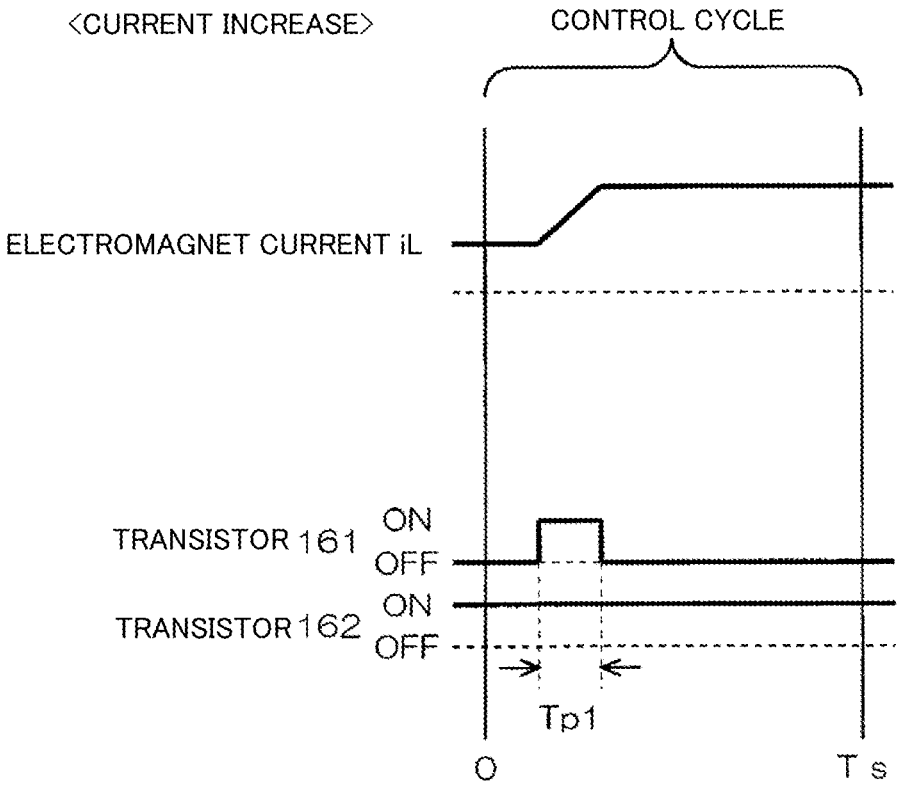
FIG. 3 is a time chart showing control performed when a current command value is greater than a detected value.

That is, when the detected current value is smaller than the current command value, as shown in FIG. 3, the transistors 161 and 162 are simultaneously on only once in the control cycle Ts (for example, 100 μs) for the time corresponding to the pulse width time Tp1. During this time, the electromagnet current iL increases accordingly toward the current value iLmax (not shown) that can be passed from the positive electrode 171*a* to the negative electrode 171*b* via the transistors 161 and 162.

Figure 4:
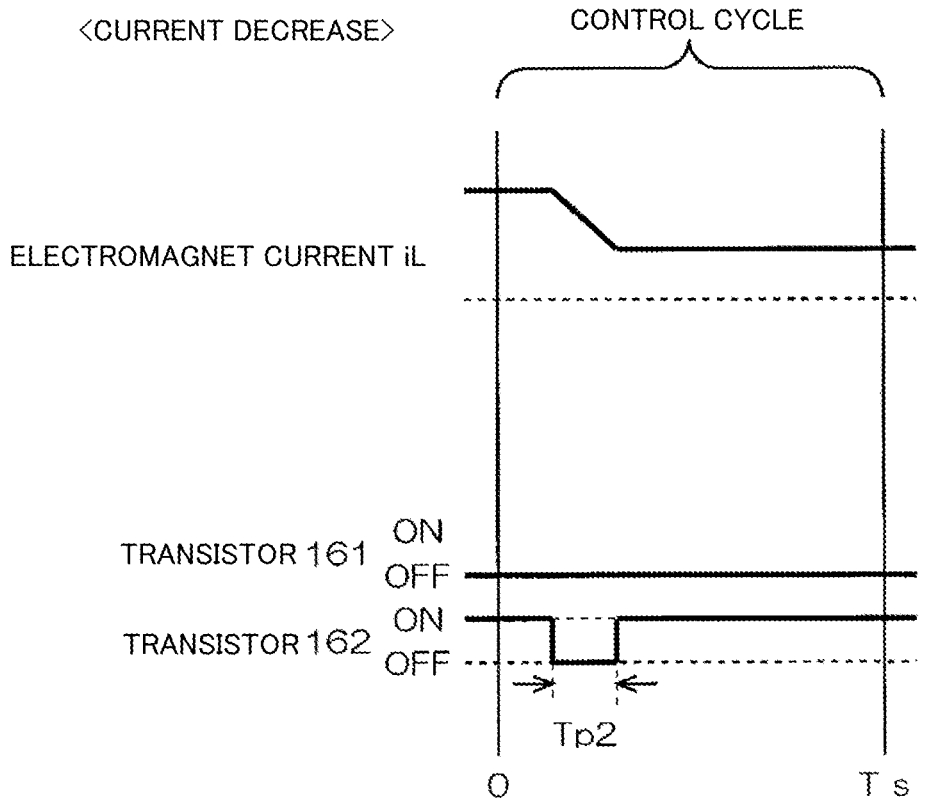
FIG. 4 is a time chart showing control performed when a current command value is less than a detected value.

When the detected current value is larger than the current command value, as shown in FIG. 4, the transistors 161 and 162 are simultaneously off only once in the control cycle Ts for the time corresponding to the pulse width time Tp2. During this time, the electromagnet current iL decreases accordingly toward the current value iLmin (not shown) that can be regenerated from the negative electrode 171*b* to the positive electrode 171*a* via the diodes 165 and 166.

In either case, after the pulse width time Tp1, Tp2 has elapsed, one of the transistors 161 and 162 is on. During this period, the freewheeling current is thus maintained in the amplifier circuit 150.

In the turbomolecular pump 100 with the basic configuration described above, the upper side as viewed in FIG. 1 (the side including the inlet port 101) serves as a suction portion connected to the target apparatus, and the lower side (the side including the base portion 129 in which the outlet port 133 protrudes rightward as viewed in the figure) serves as an exhaust portion connected to an auxiliary pump (a back pump that creates rough vacuum using a dry pump) or the like (not shown). The turbomolecular pump 100 can be used not only in an upright position in the vertical direction shown in FIG. 1, but also in an inverted position, a horizontal position, and an inclined position.

Also, in the turbomolecular pump 100, the above-mentioned outer cylinder 127 and the base portion 129 are combined to form a single case (hereinafter, they may be collectively referred to as a "main body casing" or the like). The turbomolecular pump 100 is electrically (and structurally) connected to a box-shaped electrical case (not shown), and the above-mentioned control device 200 is incorporated in the electrical case.

The configuration within the main body casing (the combination of the outer cylinder 127 and the base portion 129) of the turbomolecular pump 100 may be divided into a rotation mechanism portion, which rotates the rotor shaft 113 and the like with the motor 121, and an exhaust mechanism portion, which is rotationally driven by the rotation mechanism portion. The exhaust mechanism portion may be divided into a turbomolecular pump mechanism portion, which includes the rotor blades 102, the stator blades 123, and the like, and a groove exhaust mechanism portion, which includes the cylindrical portion 102*d*, the threaded spacer 131, and the like.

The above-mentioned purge gas is used to protect components such as the bearing portions and the rotor blades 102, prevents corrosion caused by the exhaust gas (process gas), and cools the rotor blades 102, for example. This purge gas may be supplied by a general technique.

As a general technique for supplying the purge gas, in an illustrative example, purge gas is supplied to a pipe line connected to the purge gas introduction ports 12 and 13 through a purge gas cylinder (such as a nitrogen ($N_2$) gas cylinder) or the purge gas valve 14, for example. The vacuum pump 10 shown in FIG. 1 employs such a technique.

The purge gas that has flowed through the bearing portions and the like is exhausted to the outside through the outlet port 133 together with other gas in the main body casing (combination of the outer cylinder 127 and the base portion 129). When gas other than the purge gas is present within the main body casing, the purge gas is exhausted to the outside through the outlet port 133 together with the other gas.

The protective bearing 120 described above is also referred to as a "touchdown (T/D) bearing", a "backup bearing", or the like. In case of any trouble such as trouble in the electrical system or entry of air, the protective bearing 120 prevents a significant change in the position and orientation of the rotor shaft 113, thereby limiting damage to the rotor blades 102 and surrounding portions.

In the figure showing the structure of the turbomolecular pump 100 (FIG. 1), hatch patterns indicating cross sections of components are omitted to avoid complicating the drawing.

Devices such as the above-mentioned heater 11 and the exhaust valve 16 and the control of these devices are now described. In the present embodiment, the heater 11 is of a planar type (planar heater). The heater 11 is arranged on the outer circumference of the outer cylinder 127 of the turbomolecular pump 100 and is in planar contact with the outer cylinder 127. The number of heaters 11 may be one or more than one.

The heater 11 has an external dimension that extends over the groove exhaust mechanism portion, which is formed by the threaded spacer 131 and the like, and the turbomolecular pump mechanism portion, which is formed by the rotor blades 102, the stator blades 123, and the like. The heater 11 is arranged in a section facing a large portion of the threaded spacer 131 with the outer cylinder 127 interposed therebetween.

The heater 11 changes the amount of generated heat by energization control. The heater 11 transfers the generated heat to the threaded spacer 131 and other components through the outer cylinder 127 to increase the temperature of the components inside the turbomolecular pump 100. In the present embodiment, the controller 23 of the control circuit portion 22, which is schematically shown in FIG. 5, controls the heater 11.

The control circuit portion 22 is incorporated in the control device 200 described above, and forms a part of the control device 200. The controller 23 of the control circuit portion 22 also controls the purge gas valve 14 and the exhaust valve 16. That is, the control circuit portion 22 and the controller 23 of the control circuit portion 22 are incorporated in the control device 200 and also function as a heater control means, a purge gas valve control means, and an exhaust valve control means.

Here, the purge gas valve control means and the exhaust valve control means may be collectively referred to as "valve control means". Also, the controller 23, the control circuit portion 22, and the control device 200 may be collectively or individually referred to as "purge gas valve control means", "exhaust valve control means," and "valve control means".

The control circuit portion 22 includes a storage portion 24 formed by a ROM, a RAM, or the like. A part or the whole of this storage portion 24 may be integrated in the controller 23.

The controller 23 includes a central processing unit (CPU), and according to a control program stored in the storage portion 24, refers to various control data also stored in the storage portion 24 and controls the devices to be controlled. Signals from a temperature sensor 21, a pressure sensor 25, a rotational speed sensor 27, and the like are input to the controller 23.

While monitoring signals from various sensors, the controller 23 controls the temperature of the heater 11, controls the purge gas valve 14 (on/off control in this embodiment), and controls the exhaust valve 16 (opening degree control in this embodiment), for example. The controller 23 also controls various devices such as the motor 121 and magnetic bearings (reference numerals omitted).

More specifically, the controller 23 performs control that increases the temperature of the heater 11 to a predetermined temperature and maintains the heating temperature. The controller 23 also controls the exhaust valve 16 to increase or reduce the pressure of gas in the interior of the turbomolecular pump 100. The controller 23 also operates the purge gas valve 14 as necessary to perform control relating to the introduction of the purge gas through the purge gas introduction ports 12 and 13.

In the present embodiment, the purge gas valve 14 is on/off controlled by the controller 23. However, there is no limitation to this, and the controller 23 may control the opening degree of the purge gas valve 14, and the flow rate of the purge gas supplied to the turbomolecular pump 100 may be changed according to the opening degree of the purge gas valve 14.

An operation signal of an operation mode changeover switch 26 is input to the controller 23. The operation mode changeover switch 26 is operated by an operator when switching between a normal operation mode (normal operating mode) and a cleaning operation mode (cleaning mode). As the operation mode changeover switch 26, various types of common switch devices may be used.

The above normal operation mode, which will be described in detail below, is the operation mode (operation state) to perform normal operation for maintaining a predetermined degree of vacuum in the target apparatus to which the turbomolecular pump 100 is connected (a semiconductor manufacturing apparatus in this embodiment), and transferring the gas of the target apparatus (the process gas of the semiconductor manufacturing apparatus in this embodiment). In contrast, the cleaning operation mode is an irregular operation mode to perform cleaning operation for removing side reaction products (deposits) deposited inside the turbomolecular pump 100 during operation in the normal operation mode.

Regarding these operation modes, the storage portion 24 described above stores temperature information and rotational speed information corresponding to each operation mode. As for the normal operation mode, the storage portion 24 stores first temperature information and first rotational speed information. Of these, the first temperature information indicates a first temperature that is a predetermined temperature for providing an appropriate temperature environment in the gas flow passage. The first rotational speed information indicates a first rotational speed that is a predetermined rotational speed suitable for gas transfer.

As for the cleaning operation mode, the storage portion 24 stores second temperature information and second rotational speed information. Of these, the second temperature information indicates a second temperature that is a temperature suitable for sublimating and re-vaporizing the deposits. The second temperature indicated by this second temperature information is higher than the first temperature in the normal operation mode. Also, the second rotational speed information indicates a second rotational speed lower than the first rotational speed in the normal operation mode.

The operations of the turbomolecular pump 100 in the normal operation mode and cleaning operation mode are now described in further detail. First, in the normal operation mode, the turbomolecular pump 100 rotates the motor 121 upon receiving a rotation operation start signal, which is a command signal from the controller 23. The rotation of the motor 121 rotates the rotor blades 102, starting gas exhaust and compression.

When the rotational speed of the rotor blades 102 reaches the first rotational speed described above, the adjustment of the rotational speed of the rotor blades 102 is completed. To complete the adjustment of the rotational speed, the rotational speed sensor (reference numeral 27 in FIG. 5), which is placed in a predetermined section in the main body casing (combination of the outer cylinder 127 and the base portion 129), detects the rotational speed of the rotor blades 102. Also, the detection result of the rotational speed sensor 27 is input to the controller 23, and the controller 23 determines that the rotational speed of the rotor blades 102 has reached the first rotational speed, and controls the motor 121 to keep the rotational speed constant.

In parallel with such rotational speed control, heating temperature adjustment is performed. In this heating temperature adjustment, the heater 11 is energized to raise the temperature, gradually heating the section around the heater 11. When the temperature detected by the temperature sensor 21 reaches the first temperature, the controller 23 determines that the temperature adjustment is completed, and controls the heater 11 to keep the temperature constant.

When determining that both the rotational speed and the temperature have reached their respective target values (the first rotational speed and the first temperature), the controller 23 gives notification through the display portion 28 that the turbomolecular pump 100 has shifted to a state of normal operation (steady operation). In this normal operation mode, the heater 11 increases and maintains the temperature of the gas flow passage to a constant degree, and the formation of deposits is prevented to an extent that is possible with the first temperature.

The first temperature is determined so as not to cause excessive thermal expansion or deformation of the various components (internal components) to be heated, and is a permissible temperature at which the pump can be used without a malfunction in steady operation. Furthermore, the first temperature is determined taking into account the materials and strengths of various internal components, the flow rate of gas flowing into the turbomolecular pump 100 from the vacuum chamber of the target apparatus on the upstream side, and the like.

As described above, assuming that an aluminum alloy is used as the material for major internal components, such as the outer cylinder 127, the stator blades 123, the threaded spacer 131, the rotating body 103, and the base portion 129, and that the gas flow rate is a predetermined gas flow rate that is empirically relatively common, the first temperature, which is the temperature in steady operation, may be 100° C., for example.

However, since this first temperature is merely a permissible temperature at which the pump can be used without a malfunction, deposits may be formed. For example, when the deposits are ammonium fluoride, the sublimation temperature is 150° C. Consequently, maintaining at 100° C. still forms deposits. For this reason, the present embodiment gasifies (regasifies) the formed deposits in the cleaning operation mode as described below so that the deposits can be removed.

In the cleaning operation mode, to remove the deposits, the heater 11 is controlled to increase the temperature of its surrounding portion to the second temperature higher than the first temperature associated with the normal operation mode. The second temperature is a temperature that can regasify the deposits formed in the normal operation mode. In the present embodiment, the second temperature, which is the temperature in cleaning operation, is set to 200° C. Such regeneration by gasification (regasification) enables the removal of deposits formed during operation in the normal operation mode. Here, the gas generated by regasifying the deposited side reaction products, the gas from the target apparatus (a semiconductor manufacturing apparatus in this embodiment), and the like may be collectively referred to as "processed gas".

Also, in the cleaning operation mode, the motor 121 is controlled to rotate at the second rotational speed. This second rotational speed is about 50% of the first rotational speed. By driving the motor 121 at the second rotational speed, which is sufficiently lower than the first rotational speed, the compression heat and the friction heat generated when the gas is exhausted are reduced as compared with a state in which the motor 121 is driven at the first rotational speed. This also reduces a load such as a centrifugal force applied to the rotor blades 102, allowing the permissible temperature to be higher than in the normal operation mode. At the same time, due to the molecular transport force of the rotor blades 102, the regenerated gas does not flow back toward the stator blades 123, which are not heated by the heater 11 and thus have a low temperature, and is thus exhausted to the outside of the main body casing (combination of the outer cylinder 127 and the base portion 129) through the outlet port 133. After a certain period of time from the start of rotating the rotor blades 102, the regasified deposit is completely exhausted. The "certain period of time" as used herein is determined based on conditions such as the composition of the deposits.

Figure 6:
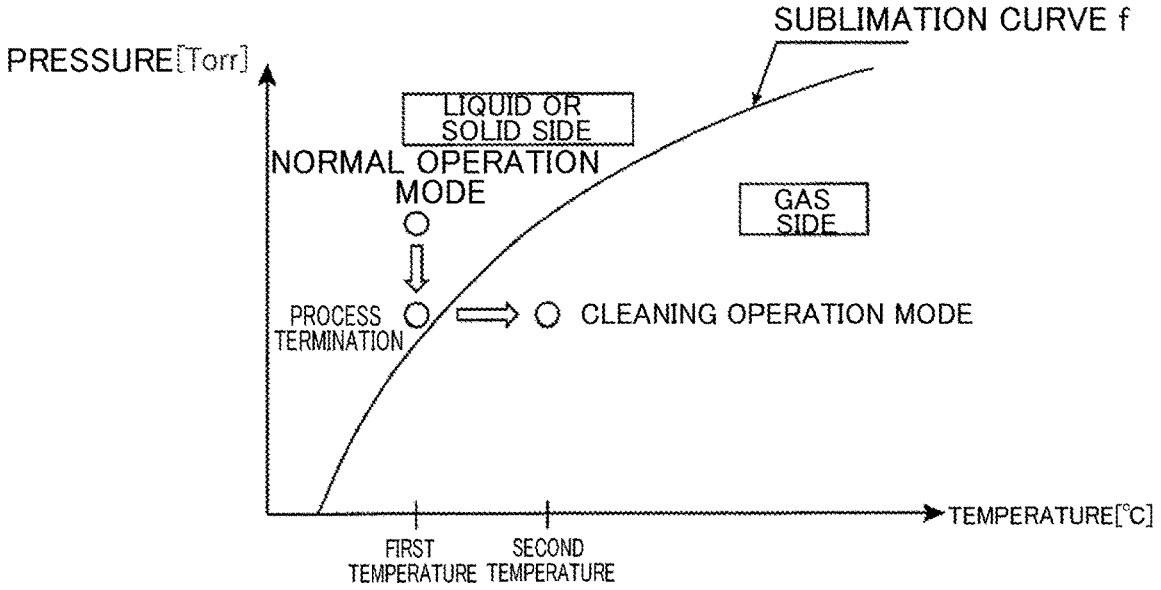
FIG. 6 is an explanatory diagram schematically showing the relationship between a normal operation mode and a cleaning operation mode using a sublimation curve.

As described above, the rotor blades 102 are used also in the cleaning operation mode to transfer the gas while rotating at a lower speed than in the normal operation mode and efficiently and smoothly removing the gasified deposit (the gas generated by sublimation of deposits). This can prevent pressure rise due to the stagnation of gasified deposit. Thus, performing both gasification at the second temperature and gas exhaust at the second rotational speed facilitates the gasification of the deposits as compared with a situation in which only the gasification at the second rotational speed is performed. The gasification of deposits may be represented by a sublimation curve f (FIG. 6) in a phase diagram showing the relationship between solid phase (solid), liquid phase (liquid), and gas phase (gas). The deposits can be gasified in the gas phase region (gas side) of the sublimation curve f, and it is desirable to set the temperature higher than the sublimation temperature to achieve the amount of heat required for gasification.

Also, the shift from the normal operation mode to the cleaning operation mode may be performed when the operator operates the above-described operation mode changeover switch 26 in the normal operation mode and the controller 23 performs control for switching modes, for example.

Conversely, the shift from the cleaning operation mode to the normal operation mode may be performed when the operator operates the above-described operation mode changeover switch 26 in the cleaning operation mode and the controller 23 performs control for switching modes, for example.

Here, during the above-mentioned "certain period of time" required for exhausting the regenerated gas, the operation mode changeover switch 26 is preferably disabled so as not to accept an operation of shifting to the normal operation mode. The controller 23 may determine whether the above "certain period of time" has elapsed, and accept an operation of the operation mode changeover switch 26 if it has elapsed. Also, control may be performed such that, when the above "certain period of time" has elapsed, the mode may be automatically shifted to the normal operation mode even without an operation on the operation mode changeover switch 26.

Furthermore, in addition to performing exhaust by the rotation of the rotor blades 102 during cleaning, the regenerated gas may be exhausted by an exhaust pump provided separately from the turbomolecular pump 100. The exhaust that is performed using another exhaust pump during cleaning as described above may be referred to as "exhaust assistance", for example.

To perform this exhaust assistance, a back pump (not shown) as an auxiliary pump installed downstream of the turbomolecular pump 100 may be used. That is, generally, in the exhaust system in which the turbomolecular pump 100 is incorporated, a back pump (not shown) may be provided downstream of the turbomolecular pump 100. This back pump performs exhaust using a lower degree of vacuum than the turbomolecular pump 100 in the stage prior to the exhaust by the turbomolecular pump 100 (prior stage). As such, exhaust may be performed using the back pump in the cleaning operation mode.

Furthermore, when the back pump as described above is used for the exhaust assistance, the back pump may be operated in the cleaning operation mode, and, in a state in which a predetermined degree of vacuum is obtained, the motor 121 of the turbomolecular pump 100 may be rotated (started to rotate) to perform exhaust operation at the second rotational speed. Performing exhaust assistance using the back pump in this manner can exhaust regenerated gas more efficiently.

The pressure control in the cleaning operation mode described above (cleaning operation pressure control) is now described. In the present embodiment, the operation period of the cleaning operation mode is divided into a period for heat transfer step and a period for sublimation step. Of these, the period for heat transfer step is a period for facilitating the heat transfer to the deposits. The period for sublimation step is a period for facilitating the sublimation of the deposits.

Figure 7:
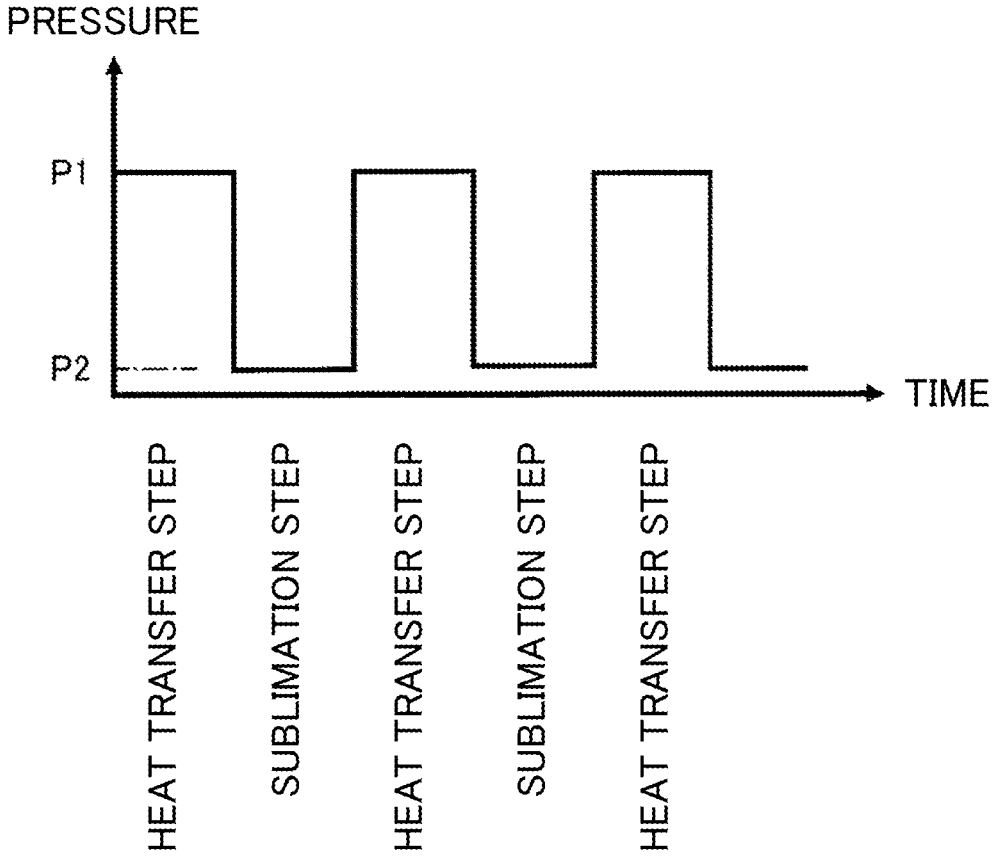
FIG. 7 is a graph schematically showing changes in pressure in the cleaning operation mode.

As shown in FIG. 7, during the period for heat transfer step, the pressure (the pressure inside the turbomolecular pump 100) is set to a relatively high first set pressure P1, and during the period for the sublimation step, the pressure is set to a relatively low second set pressure P2. In the cleaning operation mode, the heat transfer step and the sublimation step are alternately repeated to clean the interior of the turbomolecular pump 100. This is based on the following idea.

As described above, in the cleaning operation mode, while the turbomolecular pump 100 is not operated in the normal operation mode (during the standby time), the components forming the flow passage of the exhaust gas are heated to gasify and remove the deposits produced in the normal operation mode. By performing such a cleaning operation, deposits can be removed during the standby time of the vacuum pump.

Accordingly, when the turbomolecular pump 100 performs normal exhaust (exhaust in normal operation), the gas flow passage does not have to be always at a high temperature, so that the load on the components is reduced. This results in the advantage of allowing the permissible flow rate of the turbomolecular pump 100 to be increased.

The cleaning operation supplies the thermal energy necessary for the sublimation of the deposits to the deposits from the surfaces of the components heated to a high temperature. The inventor and others have focused attention on the relationship between the state of the deposits and the cleaning effect and found that, in some cases, the cleaning performance is not sufficiently exercised depending on the state of the deposits, failing to obtain the desired cleaning effect.

Specifically, for example, when deposits adhere to the wall surface of a component in the form of a thin film, the cleaning function works effectively even when only the basic cleaning operation is performed. Also, even when deposits are peeled off from the wall surface of a component and fall into the flow passage in a flaky state (flaky deposits) or in a powdery state (powdery deposits), the heat transfer is not significantly affected as long as the deposits are piled up without any gaps between one another, so that the cleaning function is sufficiently exercised.

However, when clearances are created between the deposits and the wall surface of a component, or when flaky deposits or powdery deposits are piled up with spaces between one another, the thermal energy (heat amount) may not be effectively supplied to the deposits. In such a case, heating the components does not significantly increase the surface temperature of the deposits, failing to obtain a sufficient sublimation speed (also referred to as "cleansing speed" or "cleaning speed").

Additionally, in the above-mentioned patent application (Japanese Patent Application No. 2019-165839), the applicant proposes performing the exhaust assistance using the back pump also in the cleaning operation mode. By performing such exhaust assistance in the cleaning operation mode, the pressure in the turbomolecular pump 100 can be easily lowered. As a result, the regenerated gas can be exhausted more efficiently, facilitating the sublimation of the deposits.

However, when the pressure in the turbomolecular pump 100 is lowered to a certain level (for example, about 0.1 [Torr]) by the exhaust assistance in the cleaning operation mode, the cleaning effect is reduced. This phenomenon is considered a result of the influence of clearances formed between the wall surface of a component and deposits, flaky deposits, and powdery deposits. Taking into account such deposits, the relationship between pressure drop and cleaning performance can be further described as follows.

Figure 8:
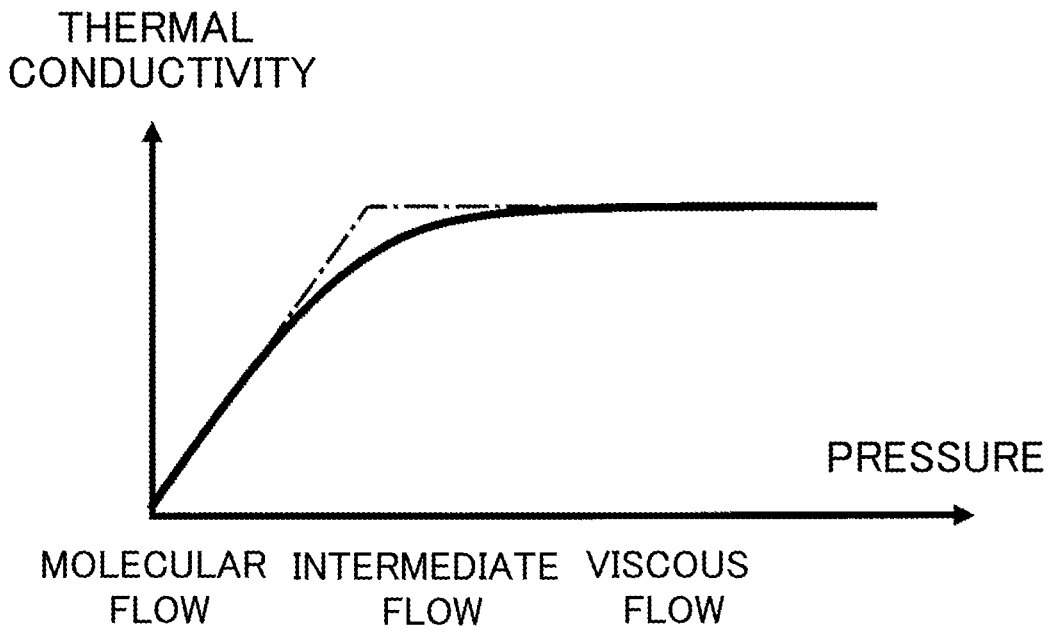
FIG. 8 is a graph showing the relationship between gas pressure and thermal conductivity.

In general, the relationship between the pressure and thermal conductivity associated with the motion state of gas is schematically represented as shown in FIG. 8. The horizontal axis of FIG. 8 indicates pressure, and the vertical axis indicates thermal conductivity. As shown in FIG. 8, when the pressure increases while the gas motion state is in the region of molecular flow (molecular flow region), the thermal conductivity gradually increases.

When the pressure further increases and the motion state transitions to the region of intermediate flow (intermediate flow region), the change in thermal conductivity becomes less steep. In the region of viscous flow (viscous flow region), the thermal conductivity does not change. In the molecular flow region, the lower the pressure, the lower the thermal conductivity (heat transfer amount).

In other words, in order to efficiently transfer heat to the deposits, it is preferable to set the motion state of the gas to a region where the intermediate flow region transitions to the viscous flow region (intermediate/viscous flow region). It may be understood that setting the pressure in at least a part of the gas flow passage to approximately the pressure at which the gas motion state changes from an intermediate flow to a viscous flow facilitates the supply of thermal energy to the deposits in that part.

Furthermore, the sublimation of deposits starts at the surfaces of the deposits. As such, sufficient sublimation speed cannot be obtained unless a large amount of heat is transferred to the surfaces of the deposits to increase the surface temperature of the deposits.

Figure 9:
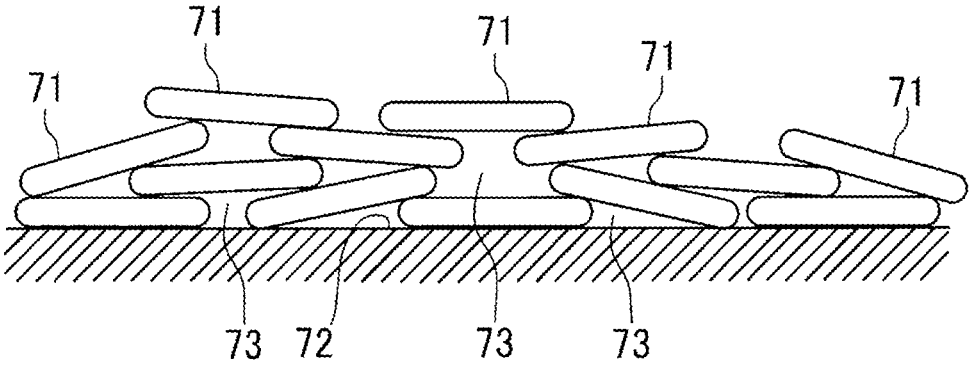
FIG. 9 is an explanatory diagram schematically showing a state of deposits that have fallen onto a component.

FIG. 9 schematically shows a state in which peeled pieces, which are flaky deposits, are piled up with spaces formed in between. Reference numeral 71 in FIG. 9 indicates the peeled pieces, and reference numeral 72 indicates the wall surface of a component on which the peeled pieces have fallen. Reference numeral 73 in FIG. 9 indicates spaces between peeled pieces 71 and other peeled pieces 71 and between peeled pieces 71 and the wall surface 72.

Many peeled pieces 71 piled up on the wall surface 72 are tilted in irregular orientations and in point contact with one another in some places. As such, when the fallen peeled pieces 71 are piled up, the contact states between adjacent peeled pieces 71 and between peeled pieces 71 and the wall surface 72 are of point contact, instead of planar contact, at many positions as shown in FIG. 9.

Accordingly, the amount of heat (heat transfer amount) transferred to a peeled piece 71 from its surface (contact surface) in contact with another peeled piece 71 or the wall surface 72 is smaller than that when the peeled piece 71 is in planar contact. Thus, the amount of heat transferred to the peeled piece 71 in point contact is assumed to be relatively small.

Trial calculations of the heat transfer amounts under different pressure conditions in a situation in which spaces are created between peeled pieces 71 can be made as follows assuming that the size (representative length) of a space 73 is 0.1 mm, for example.

First, the Knudsen number (Kn) is known as an index indicating whether a flow can be treated as a continuum.

This Knudsen number (Kn) is represented by the following expression.

$$Kn = \lambda/L = \frac{k_B\ T}{\sqrt{2}\ \pi\sigma^2 PL} \quad \text{[Math. 1]}$$

λ: Mean free path [m]
L: Representative length [m]
T: Temperature [K]
$k_B$: Boltzmann constant [J/K]
P: Pressure [Torr]
σ: Molecular diameter [m]

The gas motion state and the Knudsen number have the following relationship.

Molecular flow: Knudsen number (λ/L)>0.3
Viscous flow: Knudsen number (λ/L)<0.01

1) When the pressure (P) is 0.1 [Torr],
the mean free path of $N_2$ gas is λ=0.5 mm, and
the Knudsen number is λ/L=0.5 mm/0.1 mm=5. Here, L=0.1 mm is the size of the space 73 described above.

With this Knudsen number, the gas belongs to the molecular flow region (5>0.3), so that the heat transfer amount (thermal conductivity) is relatively small from the graph of FIG. 8.

(2) When the pressure (P) is 5.0 [Torr],
the mean free path of $N_2$ gas is λ=0.01 mm, and
the Knudsen number is λ/L=0.01 mm/0.1 mm=0.1.

With this Knudsen number, the gas belongs to the intermediate flow region (0.3>0.1>0.01), so that heat transfer through the gas is expected from the graph of FIG. 8.

Figure 5:
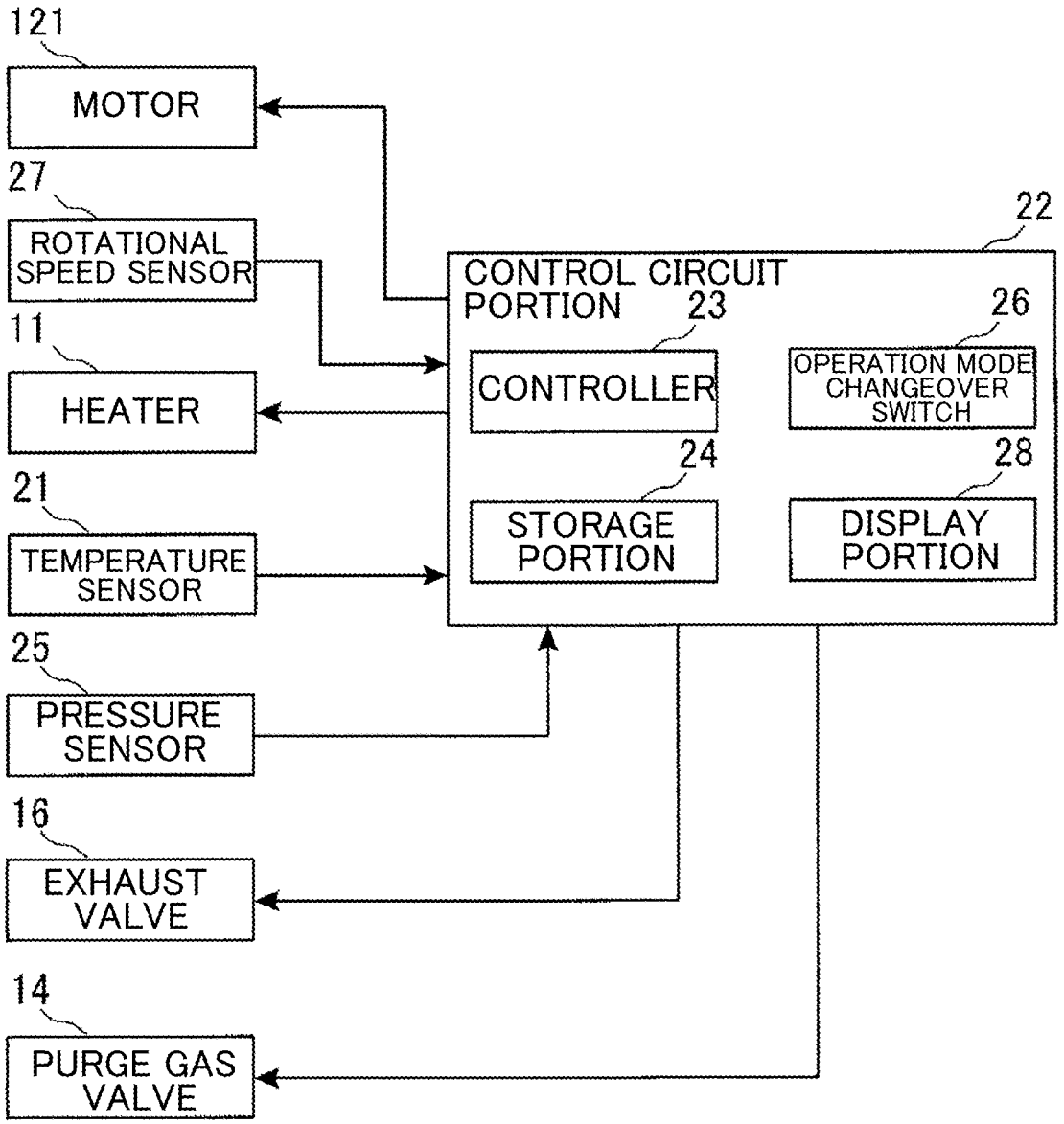
FIG. 5 is a block diagram schematically showing a configuration for controlling a vacuum pump according to an embodiment of the present invention.

Based on such trial calculations of the heat transfer amount, in the present embodiment, the heater 11 and the exhaust valve 16 shown in FIG. 5 are controlled in the cleaning operation mode. In the cleaning operation mode, the space in the turbomolecular pump 100 is used to change the pressure alternately and periodically as shown in FIG. 7.

The adjustment of the pressure as shown in FIG. 7 is performed by controlling the exhaust valve 16 while introducing the purge gas into the turbomolecular pump 100 through the purge gas introduction ports 12 and 13. This increases the pressure more reliably even when a sufficient pressure increase cannot be achieved only by supplying the purge gas through the purge gas introduction ports 12 and 13.

The pressure can be controlled while monitoring the output of the above-mentioned pressure sensor 25 (FIG. 5). However, there is no limitation to this, and the relationship between the pressure and the opening degree or opening time of the exhaust valve 16 may be obtained in advance, and the pressure may be controlled by estimating the pressure from the opening degree or time of the exhaust valve 16.

It should be noted that the control of the exhaust valve 16 for performing the heat transfer step and the sublimation step may be omitted when sufficient cleaning can be achieved by the on/off control of the purge gas valve 14 without increasing or reducing the pressure using the exhaust valve 16.

Also, as described above, in the cleaning operation mode, the temperature of the heater 11 is set to the second temperature higher than that in the normal operation mode. Furthermore, in the cleaning operation mode, the rotational speed of the motor 121 is set to the second rotational speed lower than that in the normal operation mode.

The pressure is increased to the first set pressure P1 in the heat transfer step shown in FIG. 7, so that the gas motion state shifts from the intermediate flow region to the viscous flow region. Thus, gas molecules are less likely to be dispersed, lowering the likelihood of sublimation. However, the thermal conductivity increases, allowing for satisfactory heat transfer to the deposits. The period during which this heat transfer step is performed is a heat transfer promotion period in which heat transfer is prioritized.

By shifting from this heat transfer step to the sublimation step and lowering the pressure to the second set pressure P2, the gas motion state shifts from the intermediate flow region to the molecular flow region. Thus, gas molecules are dispersed more easily, facilitating sublimation. The period during which this sublimation step is performed is a sublimation promotion period in which sublimation is prioritized.

Such switching between the heat transfer step and the sublimation step is continuously performed in the cleaning operation mode, and the cycle of heat transfer and sublimation is repeated. Accordingly, the heat transfer promotion period and the sublimation promotion period are selectively created, and the cycle of heat transfer and sublimation is repeated, so that a sufficient period is ensured. Also, the thermal energy is efficiently supplied to the deposits, thereby enhancing the cleaning effect.

FIG. 7 shows the change in pressure in a simplified manner. There is no limitation to the control mode in which the pressure change is in the form of rectangular wave, and a control mode may be adopted in which the pressure gradually changes between the first set pressure P1 and the second set pressure P2 in the form of trapezoidal wave, sine wave, or the like. Additionally, the time of the heat transfer step and the time of the sublimation step may be different from each other. Furthermore, the time required for the heat transfer step (and the time required for the sublimation step) does not have to be the same in each cycle and may vary.

When the period of the cleaning operation mode is predetermined, for example, this period may be divided into a first half and a second half, the heat transfer step may be performed in the first half, and the sublimation step may be performed in the second half. Nevertheless, since it is easier to limit a temperature decrease of the deposits when the heat transfer step and the sublimation step of relatively short periods are repeated, a control mode in which the heat transfer step and the sublimation step of relatively short periods are repeated is preferably adopted.

In the present embodiment, the flow rate of the purge gas supplied in the cleaning operation mode is set such that the partial pressure of the gasified deposit (gas generated by sublimation of deposits) is less than or equal to half of the saturated vapor pressure of the deposits at that temperature (also referred to as "deposit sublimation pressure"). This is for the following reasons.

When the purge gas is increased, the partial pressure of the gas other than the purge gas is lowered, and the partial pressure of the deposits is also lowered. The deposits are more likely to sublimate when the partial pressure is lower. However, whether the deposits actually sublimate satisfactorily depends on the degree of partial pressure of the deposits relative to the saturated vapor pressure of the deposits.

For example, assume that the total gas pressure before the purge gas is supplied is 1 [Torr], and the partial pressure of the deposits is 0.1 [Torr] (=10%). In this situation, when the purge gas is supplied at a flow rate that causes the partial pressure of the purge gas to be 90% while maintaining the total pressure, the ratio of the original gas is 10% of the total, and the partial pressure of the deposits is reduced to 0.01 [Torr], which is 10% of the original partial pressure.

Also, in practice, the degree of sublimation of deposits is limited by the saturated vapor pressure of the deposits. As such, half of the saturated vapor pressure of the deposits is set as a guide reference value, and the supply amount of purge gas is set such that the partial pressure of the deposits is maintained at not more than this reference value. Examples of gasified deposit (gas generated by sublimation of deposits) include titanium tetrafluoride ($TiF_4$) and aluminum chloride ($AlCl_3$).

Additionally, in the present embodiment, the pressure in the turbomolecular pump 100 is increased so that at least a part of the gas flow passage has a pressure of 2 [Torr] or more. The pressure set value of 2 [Torr] is adopted based on the fact that, taking into account the expected size and the like of deposits, the gas transitions from a molecular flow to an intermediate flow at a pressure of about 2 [Torr] in the vacuum pump 10 in which the turbomolecular pump 100 as in the present embodiment is incorporated. By setting the first set pressure P1 to 2 [Torr] or more using 2 [Torr] as a guideline, heat can be efficiently transferred to the deposits. The upper limit value of the first set pressure P1 may be set to 10 [Torr], for example.

As the purge gas, in addition to $N_2$, gas containing at least one gas having a high thermal conductivity, such as helium (He) or hydrogen ($H_2$), can be used. Furthermore, the purge gas may be gas (mixed gas) in which a plurality of types of gases such as the above are mixed.

The vacuum pump 10 of the present embodiment as described above is configured to, in the cleaning operation mode, control at least one of the heater 11, the gas introduction means (the purge gas valve 14 in this embodiment), and the pressure control means (the exhaust valve 16 in this embodiment), and increase a pressure in at least a part of an interior of the turbomolecular pump 100 to a pressure region (region that causes the first set pressure P1) with which a temperature is greater than or equal to a sublimation temperature of the deposits in the vacuum pump (second temperature) and that causes an intermediate flow or a viscous flow.

Here, as described above, controlling at least one of the heater 11, the gas introduction means (the purge gas valve 14 in this embodiment), and the pressure control means (the exhaust valve 16 in this embodiment) so that the pressure is increased means that when the target pressure is achieved only by controlling one device among the heater 11, the purge gas valve 14, and the exhaust valve 16 after operating the turbomolecular pump 100 in the normal operation mode, for example, control of the other devices does not have to be performed.

By controlling the heater 11, the gas introduction means (the purge gas valve 14 in this embodiment), and the pressure control means (the exhaust valve 16 in this embodiment) in this manner, heat can be transferred through the gas, facilitating the heat transfer from the wall surface 72 of the component to the deposits (flaky deposits or powdery deposits in this embodiment) (execution of the heat transfer step).

Furthermore, after that, the pressure in at least a part of the interior of the turbomolecular pump 100 is reduced to a pressure region (region that causes the second set pressure P2) with which the temperature is greater than or equal to the sublimation temperature of the deposits in the vacuum pump (second temperature) and that causes an intermediate flow or a molecular flow. This allows the deposits to which heat has been transferred to sublimate (execution of the sublimation step).

Since the sublimation step is performed following the heat transfer step, it is possible to constantly sublimate the deposits to which a sufficient amount of thermal energy has been supplied. Thus, cleaning for deposits can be performed effectively, and the cleaning performance of the vacuum pump 10 can be improved. Moreover, the cleansing effect is improved, and deposits can be effectively removed in a short time.

As a result of the above, the maintenance time of apparatuses, such as the turbomolecular pump 100, can be shortened. Also, the productivity of products to be manufactured (e.g., semiconductor manufacturing) using the apparatus to which vacuum exhaust is performed can also be improved.

When gas is supplied while the turbomolecular pump 100 is operating in the cleaning operation mode, the gas undergoes adiabatic compression in the flow passage, thereby increasing the temperature of the gas. Accordingly, this may provide the advantageous effect of directly transferring the thermal energy of the gas itself to the deposits, in addition to the heat transfer from the wall surface 72 of the component.

The above-described clearances of deposits, flaky deposits, and powdery deposits may occur anywhere in the gas flow passage. Thus, at least a part of the gas flow passage needs to satisfy the temperature condition and pressure condition in the cleaning operation mode as described above.

Additionally, there are various components and locations where flaky deposits and powdery deposits are likely to accumulate. The wall surface 132 of the screw thread 131*b* defining the thread groove 131*a* in the threaded spacer 131 is one of the components and locations where flaky deposits and powdery deposits are particularly likely to accumulate. For this reason, placing the heater 11 near the threaded spacer 131 is effective in facilitating a temperature increase.

Additionally, a non-viscous coating may be applied to areas where deposits are likely to accumulate. Examples of the non-viscous coating include coating with a film formed by fluoropolymer treatment.

According to the vacuum pump 10 of the present embodiment, at least a part of the interior of the turbomolecular pump 100 is controlled such that the first set pressure P1 that causes an intermediate flow or a viscous flow and the second set pressure P2 that causes a molecular flow are alternately repeated. Thus, after the sublimation step, the pressure around the deposits can be increased again to a degree that causes the gas to be an intermediate flow or a viscous flow, and the thermal energy consumed for the previous sublimation can be quickly replenished. The sublimation of the deposits can be continuously facilitated thereafter. This allows the cleaning effect (cleansing effect) to be continuously exercised.

Also, according to the vacuum pump 10 of the present embodiment, in the cleaning operation mode, the rotational speed of the turbomolecular pump 100 is set lower than in a normal operation mode. Thus, the compression heat and the friction heat generated when the gas is exhausted can be reduced as compared with those in the normal operation mode.

According to the vacuum pump 10 of the present embodiment, in the cleaning operation mode, a partial pressure of gas generated by sublimation of the deposits is controlled to be less than or equal to half of a sublimation pressure (saturated vapor pressure) of the deposits. It is thus possible to sublimate the deposits satisfactorily.

According to the vacuum pump 10 of the present embodiment, in the cleaning operation mode, the pressure in at least a part of the turbomolecular pump 100 is increased to 2 [Torr] or more. This allows the sublimation to take place reliably and satisfactorily at a pressure around which the gas transitions from a molecular flow to an intermediate flow.

According to the vacuum pump 10 of the present embodiment, in the cleaning operation mode, the pressure in at least a part of the turbomolecular pump 100 is increased to 10 [Torr] or less. Thus, it is possible to sufficiently transfer heat to the deposits in the heat transfer step.

According to the vacuum pump 10 of the present embodiment, the gas supplied from the purge gas introduction ports 12 and 13 to the turbomolecular pump 100 includes at least one of nitrogen gas, helium gas, and hydrogen gas. As such, the pressure control can be performed using a common general-purpose gas.

According to the vacuum pump 10 of the present embodiment, not only the purge gas introduction port 13 on the downstream side of the turbomolecular pump 100 but also the purge gas introduction port 12 on the upstream side is used to supply purge gas from the upstream side of the turbomolecular pump mechanism portion, which is formed by the rotor blades 102, and stator blades 123, and the like. This prevents a situation in which the gasified deposit flows back toward the turbomolecular pump mechanism portion and the gasified deposit flows into the gap between the rotor shaft 113 and the stator column 122.

In addition to the gas described above, $CF_4$ (carbon tetrafluoride) gas may be used as the purge gas, for example. Also, the purge gas may be introduced through the inlet port 101, for example.

In the present embodiment, the heater 11 (heating means), the purge gas introduction ports 12 and 13 (gas introduction means), and the exhaust valve 16 (pressure control means) are described as devices provided separately from the turbomolecular pump 100. However, at least one of these devices may be integrated with the turbomolecular pump 100 and provided as an object included in the turbomolecular pump 100 (as an object that is sold or distributed in the market integrally as a part of the turbomolecular pump 100).

According to the vacuum pump 10 of the present embodiment, a planar type heater (planar heater) is used as the heater 11. This allows the temperature distribution to be uniform, enabling even (uniform) heating and regasification over a wide area. Also, it is possible to prevent deposits from partially remaining. As a result, the frequency of overhauls and the like can be reduced. Furthermore, it is possible to reduce the cost of overhauls and the like, as well as to improve the efficiency of producing semiconductors or the like.

The heater is not limited to a planar type heater, and various types of heaters may be used. For example, a cartridge type heater may be used as the heater. In this case, the heater may be inserted from the outside of the outer cylinder 127 into the threaded spacer 131 or a component that can transfer heat to the threaded spacer 131.

A sheath heater can be used as the heater. Furthermore, various other general heaters may be used in place of a planar heater, cartridge heater, and sheath heater. Examples of various general heaters include an IH heater as an electromagnetic induction heater. For example, when an IH heater is used, a predetermined temperature can be reached in a relatively short time, so that time required for regasification and cleaning can be further shortened.

As for the combination of components of the turbomolecular pump 100 and their materials, other than the rotating body 103 being made of an aluminum alloy, the rotating body 103 may be made of a stainless steel alloy, for example. Also, a component other than the rotating body 103 may be made of a stainless steel alloy. Furthermore, for example, an aluminum alloy may be used as the material of a component that especially requires properties such as high thermal conductivity, light weight, and ease of processing, and a stainless steel alloy may be used as the material of a component that especially requires properties such as high rigidity and strength. In addition to aluminum alloys and stainless steel alloys, titanium alloys, for example, may also be used.

It should be noted that the present invention is not limited to the above-described embodiments, and many modifications can be made by the ordinary creative ability of those skilled in the art within the scope of the technical idea of the present invention.

Although elements have been shown or described as separate embodiments above, portions of each embodiment may be combined with all or part of other embodiments described above.

Although the subject matter has been described in language specific to structural features and/or methodological acts, it is to be understood that the subject matter defined in the appended claims is not necessarily limited to the specific features or acts described above. Rather, the specific features and acts described above are described as example forms of implementing the claims.

The invention claimed is:

1. A vacuum pump wherein a heater, a gas introducer including a purge gas introduction port and a purge gas valve, and an exhaust valve are disposed, the vacuum pump comprises a controller configured to switch an operation mode from a normal operation mode to a cleaning mode that is capable of sublimating deposits in the vacuum pump, and the controller is configured to, in the cleaning mode, drive the vacuum pump at a second rotational speed that is lower than a first rotational speed used in the normal operation mode; and set a temperature in at least a part of an interior of the vacuum pump to be greater than or equal to a sublimation temperature of the deposits in the vacuum pump by control of the heater, and increase a pressure in the at least the part of the interior of the vacuum pump to be a pressure region that causes an intermediate flow or a viscous flow by control of an induction amount of purge gas with the gas introducer and an open and close control of the exhaust valve.

2. The vacuum pump according to claim 1, wherein the at least the part of the interior of the vacuum pump is controlled such that a first set pressure that causes an intermediate flow or a viscous flow and a second set pressure that causes a molecular flow are alternately repeated.

3. The vacuum pump according to claim 1, wherein, in the cleaning mode, a rotational speed of the vacuum pump is set lower than in a normal state.

4. The vacuum pump according to claim 1, wherein, in the cleaning mode, a partial pressure of gas generated by sublimation of the deposits is controlled to be less than or equal to half of a sublimation pressure of the deposits.

5. The vacuum pump according to claim 1, wherein, in the cleaning mode, a pressure in at least a part of the vacuum pump is increased to 2 Torr to 10 Torr.

6. The vacuum pump according to claim 1, wherein gas supplied from the gas introduction port to the vacuum pump includes at least one of nitrogen gas, helium gas, and hydrogen gas.

7. A vacuum exhaust apparatus comprising:

a vacuum pump;

a heater;

a gas introducer including a purge gas introduction port and a purge gas valve; and an exhaust valve, wherein the vacuum exhaust apparatus comprises a controller configured to switch an operation mode from a normal operation mode to a cleaning mode that is capable of sublimating deposits in the vacuum pump, and the controller is configured to, in the cleaning mode, drive the vacuum pump at a second rotational speed that is lower than a first rotational speed used in the normal operation mode; and set a temperature in at least a part of an interior of the vacuum pump to be greater than or equal to a sublimation temperature of the deposits in the vacuum pump by control of the heater, and increase a pressure in the at least the part of the interior of the vacuum pump to be a pressure region that causes an intermediate flow or a viscous flow by control of an induction amount of purge gas with the gas introducer and an open and close control of the exhaust valve.

* * * * *